US006867678B2

(12) United States Patent
Yang

(10) Patent No.: US 6,867,678 B2
(45) Date of Patent: Mar. 15, 2005

(54) TRANSFORMER STRUCTURE

(75) Inventor: Lee-Lung Yang, Chu-Pei (TW)

(73) Assignee: Entrust Power Co., Ltd., Taiwan (TW)

( * ) Notice: Subject to any disclaimer, the term of this patent is extended or adjusted under 35 U.S.C. 154(b) by 0 days.

(21) Appl. No.: 10/351,995

(22) Filed: Jan. 28, 2003

(65) Prior Publication Data

US 2004/0145445 A1 Jul. 29, 2004

(51) Int. Cl.[7] ..... H01F 5/00

(52) U.S. Cl. ..... 336/200; 336/223; 336/232

(58) Field of Search ..... 336/200, 223, 336/232, 212, 83, 96; 29/602.1, 606

(56) References Cited

U.S. PATENT DOCUMENTS 5,353,001 A * 10/1994 Meinel et al. ..... 336/83
5,600,293 A * 2/1997 Hunter ..... 336/182
5,631,822 A * 5/1997 Silberkleit et al. ..... 363/144
6,529,389 B2 * 3/2003 Perlick et al. ..... 363/20
6,590,788 B2 * 7/2003 Mercier ..... 363/21.06

* cited by examiner

*Primary Examiner*—Anh Mai

(57) ABSTRACT

The present invention describes a planar transformer having a plurality of juxtaposed magnetic cores as well as a two-layer printed circuit board for spiralling a plurality of windings. Each arm of a plurality of juxtaposed magnetic cores respectively goes through a corresponding hole in the middle of these windings, to magnetically couple the current in the main winding to the other windings.

13 Claims, 3 Drawing Sheets

TRANSFORMER STRUCTURE

FIELD OF THE INVENTION

The present invention relates to a transformer, and more specifically, to a structure of a planar transformer.

BACKGROUND OF THE INVENTION

Transformers are necessary in many types of electrical apparatus.

A basic transformer comprises primary coils, secondary coils and a core. The coils are made, for example, of copper wire. They may be arranged so as to be juxtaposed. Alternatively, they may be arranged so that one coil surrounds another coil. A coil has one or more windings. As a result of the ongoing reduction in size of electrical apparatus, transformers manufactured also comprise coils having smaller dimensions. Said coils may be made, for example, from a number of layers of an insulating material on which winding portions of the coils are provided. A transformer of this type is referred to as a multilayer or planar transformer.

FIG. 1A is the top view of a conventional planar transformer. FIG. 1B shows an exploded top view of the conventional planar transformer. In this type of transformer, the primary windings 100, which are a spiral of traces on a planar surface 104, are coupled to the secondary windings 102, which are a different spiral of traces on a separate planar surface 106. A thin dielectric insulator 112 is located between the first windings 100 and secondary windings 102. Magnetic cores 108 and 110 enclose the windings 100 and 102 and the insulator 112. Typically, the magnetic core is made of ferrite or some other composite material that is shaped as a pot-core, an R-M core, an E core, an I core, etc. However, the core can be almost any shape that is easy to place around the windings and effectively confines the magnetic field to the area around the windings.

FIG. 1C shows an exploded bottom view of the conventional planar transformer. The first windings 100 through the hole 114 provide an input end 118 under the planar surface 104. The second windings 102 through the hole 116 provide an output end 120 under the planar surface 106. If a current is sent to the input end 118 of the first windings 100, magnetic flux causes a current to be generated in the secondary windings 102. The core conducts this flux since it is made of a material having good magneto-conductive properties. During operation, the input end 118 is connected to the power supply and the output end is connected to the current circuit of the apparatus receiving energy from the power supply.

The use of planar traces rather than the classical wire windings on a bobbin is a significant manufacturing advance for high-frequency transformers. However, in accordance with the conventional structure, a two-layer printed circuit board is required to build each winding. In other words, realization of a planar transformer with N windings requires 2N-layers printed circuit board. This increases the manufacture cost. As a result of the ongoing reduction in cost of equipment, a further reduction in cost of the planar transformers is desirable.

SUMMARY OF THE INVENTION

In accordance with the foregoing description, the conventional structure of the planar transformer needs to be realized by using a multi-layers printed circuit board to spiral a plurality of windings. This kind of multi-layers printed circuit board has a high cost.

Therefore, this main purpose of the present invention is to provide a transformer structure using just a two-layer printed circuit board to spiral a plurality of windings.

Another purpose of the present invention is to provide a transformer structure that is inexpensive to manufacture.

A further purpose of the present invention is to provide a high frequency transformer structure that is inexpensive to manufacture.

The preferred embodiment of the present invention relates to a planar transformer comprising a plurality of juxtaposed magnetic cores as well as a two-layer printed circuit board for spiral a plurality of windings. Each arm of a plurality of juxtaposed magnetic cores respectively goes through a corresponding hole in the middle of these windings, to magnetically couple the current in the main winding to the other windings. Use of a multi-layer printed circuit board is not necessary in the structure. Therefore, this structure may reduce the manufacture cost.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein.

DETAILED DESCRIPTION OF THE PREFERRED EMBODIMENT

Without limiting the spirit and scope of the present invention, the planar transformer structure proposed in the present invention is illustrated with one preferred embodiment. Skilled artisans, upon acknowledging the embodiment, can apply the transformer structure of the present invention to any kind of converter. The transformer structure of the present invention can reduce the manufacturing cost. The following examples use the planar transformer to describe the structure of the present invention, however, the application of the present invention does in not limited to the preferred embodiment described in the following.

Figure 1A:
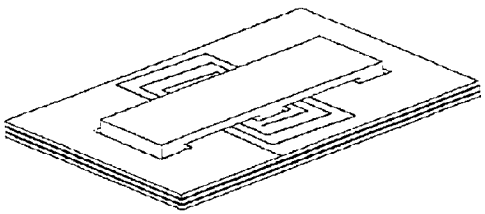
Fig. 1A (PRIOR ART)
FIG. 1A is the top view of a conventional planar transformer.
Figure 1C:
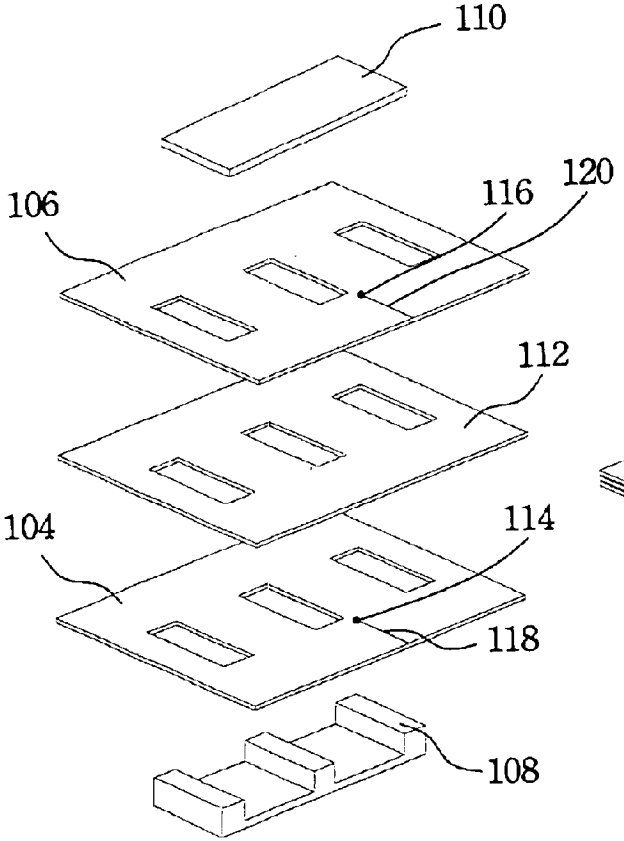
Fig. 1C (PRIOR ART)
FIG. 1C shows an exploded bottom view of the conventional planar transformer.
Figure 1B:
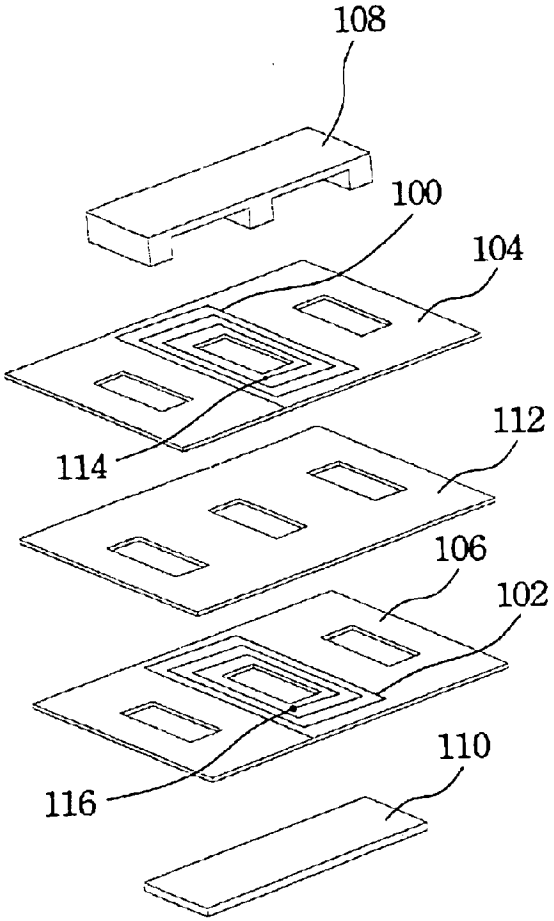
Fig. 1B (PRIOR ART)
FIG. 1B shows an exploded top view of the conventional planar transformer.
Figure 2A:
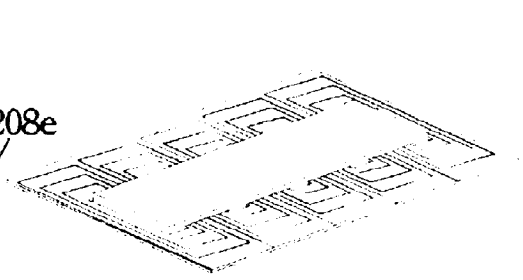
FIG. 2A is the top view in accordance with the first embodiment of a planar transformer.
Figure 2C:
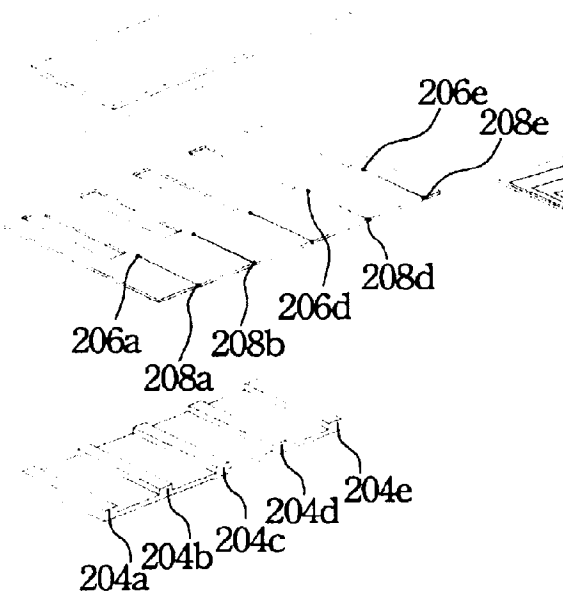
FIG. 2C shows an exploded bottom view in accordance with the first embodiment of a planar transformer.
Figure 2B:
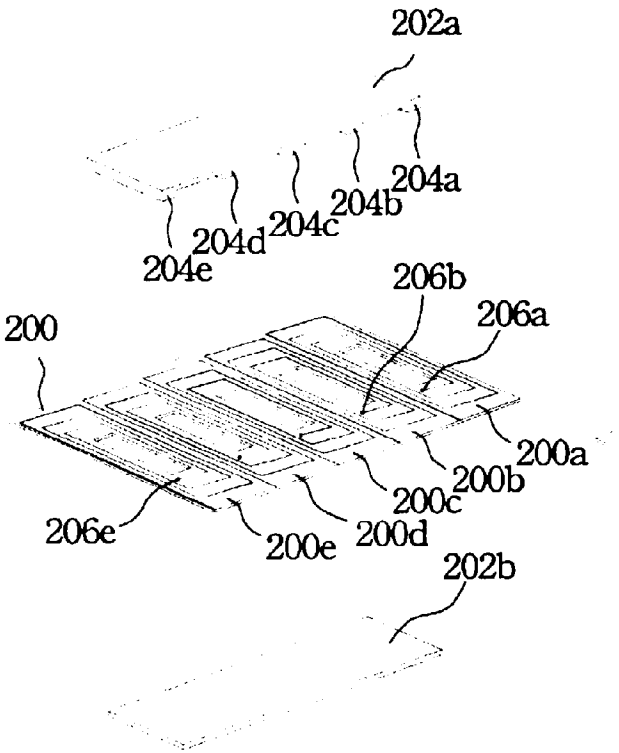
FIG. 2B shows an exploded top view in accordance with the first embodiment of a planar transformer.

FIGS. 2A to 2C show the first preferred embodiment of the present invention. FIG. 2A is the top view in accordance with the first embodiment of a planar transformer and relates to a planar transformer comprising a core with five juxtaposed arms as well as a two-layer printed circuit board for spiraling a plurality of windings. It is noted that the plurality of windings may be also built in different two-layer printed circuit board. Each arm of the core respectively goes through a corresponding hole in the middle of these windings, to magnetically couple the current in the main winding to the other windings.

FIG. 2B shows an exploded top view in accordance with the first embodiment of a planar transformer. A selected number of windings is shown in FIG. 2B, but anyone skilled in the art will understand that the number of the windings of the transformer is changeable. The elements of the transformer described in the FIG. 2B are: five juxtaposed windings 200*a* to 200*e* formed over a two-layer printed circuit board 200 and five-arm ferrite core members 202*a* and 202*b*. Five juxtaposed windings 200*a* to 200*e* can have spiralling conductor traces or some other wiring pattern that carries transformer current. In this embodiment, five juxtaposed windings 200*a* to 200*e* are wired in spiral traces. The spiral traces of windings 200*a* to 200*e* carry the current of this transformer.

Each arm of the ferrite core goes through the corresponding hole in the middle of the winding. For example, the arm 204*a* of the ferrite core goes through the hole in the middle of the winding 200*a*. The arm 204*b* of the ferrite core goes through the hole in the middle of the winding 200*b* and so on. Five-arm ferrite core members 202*a* and 202*b* enclose the five juxtaposed windings 200*a* to 200*e*. Typically, five-arm ferrite core members 202*a* and 202*b* are made of ferrite or some other composite material. The five-arm ferrite core is shaped in any shape that is easy to place around the windings and effectively confines the magnetic field to the area around the windings.

FIG. 2C shows an exploded bottom view in accordance with the first embodiment of the present invention. The five juxtaposed windings 200*a* to 200*e* respectively through the hole 206*a* to 206*e* to provide electrical connection point 208*a* to 208*e* under the planar surface 200. For example, the winding 200*a* is the primary winding. The main current is sent to the electrical connection point 208*a* of the first windings 200*a*, then, the magnetic flux may cause corresponding currents to be generated in the other windings 200*b* to 200*e*. Therefore, the electrical connection point 208*b* to 208*e* of the windings 200*b* to 200*e* may respectively provide the required current to the current circuits of the applications.

Figure 3A:
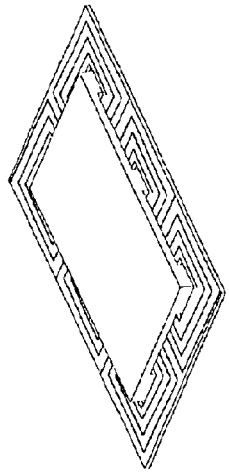
FIG. 3A is the top view in accordance with the second embodiment of a planar transformer.
Figure 3C:
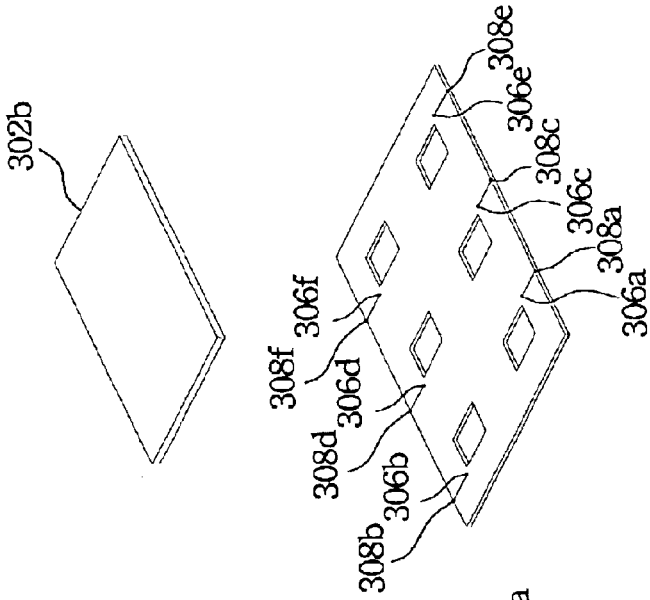
FIG. 3C shows an exploded bottom view in accordance with the second embodiment of a planar transformer.
Figure 3C:
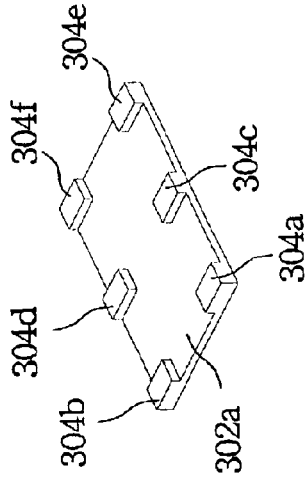
Figure 3B:
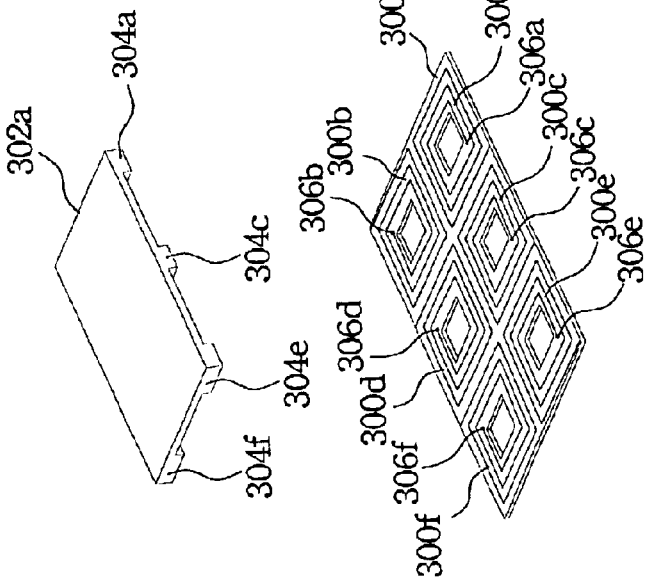
FIG. 3B shows an exploded top view in accordance with the second embodiment of a planar transformer.
Figure 3B:
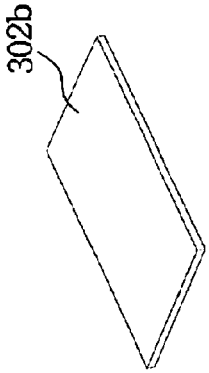

FIGS. 3A to 3C show the second preferred embodiment of the present invention. FIG. 3A is the top view in accordance with the second embodiment of a planar transformer. It relates to a planar transformer comprising a core with six arms as well as a two-layer printed circuit board in which six windings are spiraled. Each arm of the core respectively goes through a corresponding hole in the middle of these windings, to magnetically couple the current in the main winding to the other windings.

FIG. 3B shows an exploded top view in accordance with the second embodiment of a planar transformer. The elements of the transformer described in the FIG. 3B are: six windings 300*a* to 300*f* formed over a two-layer printed circuit board 300 and six arms ferrite core members 302*a* and 302*b*. Similarly, the six windings 300*a* to 300*f* can have spiralling conductor traces or some other wiring pattern. In this embodiment, six windings 300*a* to 300*f* are wired in a spiral trace.

Each arm of the ferrite core goes through the corresponding hole in the middle of the winding. For example, the arm 304*a* of the ferrite core goes through the hole in the middle of the winding 300*a* and so on. Six arms ferrite core members 302*a* and 302*b* enclose the six windings 300*a* to 300*f*. Typically, the ferrite core members 302*a* and 302*b* are made of ferrite or some other composite material. The ferrite core can any shape that is easy to place around the windings and effectively confines the magnetic field to the area around the windings.

FIG. 3C shows an exploded bottom view in accordance with the second embodiment of the present invention. Similarly, the six windings 300*a* to 300*f* respectively go through the holes 306*a* to 306*e* to provide electrical connection point 308*a* to 308*f* under the planar surface 300.

Obviously, in accordance with the above description of the two embodiments, the present invention uses just a two-layer printed circuit to spiral a plurality of windings. Therefore, the structure of the present invention is inexpensive to manufacture. It is noticed that the structure of the present invention may also be applied in other transformers.

It is noted that the printed circuit board used in the present invention does not be limited in a two-layers printed circuit board. For example, a two-layers printed circuit board and a four-layers printed circuit board may be used to spiral three windings. In other words, in accordance with the present invention, the maximum number of the layers of printed circuit board for spiraling three windings is four in this example, which is different from the prior art that needs six-layers printed circuit board. Therefore, the present invention may reduce the manufacture cost.

As is understood by a person skilled in the art, the foregoing descriptions of the preferred embodiment of the present invention are an illustration of the present invention rather than a limitation thereof. It is intended to cover various modifications and similar arrangements included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A transformer structure, said structure comprising:

at least three juxtaposed conductor traces, wherein a middle of each conductor trace has a hole; and a core having at least three arms, wherein each arm goes through a corresponding hole.

2. The transformer structure of claim 1, wherein said juxtaposed conductor traces are formed over a two-layer printed circuit board.

3. The transformer structure of claim 1, wherein the conductor traces are wired in a spiral trace.

4. The transformer structure of claim 1, wherein each conductor trace is a multiple-turn winding.

5. The transformer structure of claim 1, wherein the core is a ferrite core.

6. A transformer structure, said structure comprising:

a two-layer printed circuit board with at least three conductor traces and at least three holes, wherein each conductor trace surrounds a corresponding hole; and a core having at least three arms, wherein each arm goes through a corresponding hole.

7. The transformer structure of claim 6, wherein the core defines a magnetic path through said arms and respectively linking said conductor traces.

8. The transformer structure of claim 6, wherein the conductor traces are wired in a spiral trace.

9. The transformer structure of claim 6, wherein the conductor trace is a multiple-turn winding.

10. The transformer structure of claim 6, wherein the core is a ferrite core.

11. A transformer structure, said structure comprising:

a two-layer printed circuit board with at least three conductor traces and at least three holes, wherein each conductor trace surrounds a corresponding hole; and a ferrite core having at least three arms, wherein each arm goes through a corresponding hole.

12. The transformer structure of claim 11, wherein the ferrite core defines a magnetic path through said arms and respectively linking said conductor traces.

13. The transformer structure of claim 11, wherein the conductor traces are wired in a spiral trace.

* * * * *